US008742938B2

(12) United States Patent
Casey

(10) Patent No.: US 8,742,938 B2
(45) Date of Patent: Jun. 3, 2014

(54) MULTIFUNCTIONAL/MODULAR SMOKE ALARM DEVICE HAVING PARTICULAR HOUSING FEATURES

(76) Inventor: Daniel P. Casey, Seattle, WA (US)

( * ) Notice: Subject to any disclaimer, the term of this patent is extended or adjusted under 35 U.S.C. 154(b) by 131 days.

(21) Appl. No.: 13/503,326

(22) PCT Filed: Oct. 22, 2010

(86) PCT No.: PCT/US2010/053753

§ 371 (c)(1),
(2), (4) Date: Apr. 20, 2012

(87) PCT Pub. No.: WO2011/050269

PCT Pub. Date: Apr. 28, 2011

(65) Prior Publication Data

US 2012/0210785 A1 Aug. 23, 2012

Related U.S. Application Data

(63) Continuation-in-part of application No. 12/604,990, filed on Oct. 23, 2009, now Pat. No. 8,089,769.

(51) Int. Cl.
*G08B 21/00* (2006.01)

(52) U.S. Cl.
USPC ..... 340/628; 340/693.5

(58) Field of Classification Search
CPC ..... G08B 17/10; G08B 17/00
USPC ..... 340/628–630, 693.5–693.12; 250/288; 356/432–444
See application file for complete search history.

(56) References Cited

U.S. PATENT DOCUMENTS

| | | | |
|---|---|---|---|
| 3,434,133 | A | 3/1969 | Collum |
| 4,623,878 | A | 11/1986 | Schoenwetter |
| 4,710,756 | A | 12/1987 | Thornburg et al. |
| 5,139,464 | A | 8/1992 | Lehnert |
| 5,519,382 | A | 5/1996 | Pope et al. |
| 6,114,967 | A | 9/2000 | Yousif |
| 6,160,487 | A | 12/2000 | DeLuca |
| 6,181,251 | B1 | 1/2001 | Kelly |
| 7,034,702 | B2 | 4/2006 | Thomas et al. |
| 7,336,165 | B2 | 2/2008 | Fuchs |

FOREIGN PATENT DOCUMENTS

| | | | |
|---|---|---|---|
| WO | 2005/035910 | A1 | 4/2005 |

*Primary Examiner* — Jeffery Hofsass

(57) ABSTRACT

A smoke detector device featuring a base for mounting to a ceiling, wall, or fixture. The base has three grooves disposed in its outer surface. Rings can wrap around each groove on the base. Each ring has at least two modules with an inner chamber and a door, wherein the inner chamber of each module can hold an item. The base can move between an expanded position wherein the three grooves are exposed and a collapsed position wherein only one groove is exposed. Flanges and set screws can secure the base in the expanded position.

19 Claims, 12 Drawing Sheets

MULTIFUNCTIONAL/MODULAR SMOKE ALARM DEVICE HAVING PARTICULAR HOUSING FEATURES

CROSS REFERENCE

This application is a continuation-in-part of U.S. patent application Ser. No. 12/604,990 filed Oct. 23, 2009, which claims priority to U.S. Provisional Patent Application Ser. No. 61/225,520 filed Jul. 14, 2009, the specifications of which are incorporated herein by reference in their entirety.

FIELD OF THE INVENTION

The present invention is directed to smoke detectors, more particularly to an improved smoke detector comprising a plurality of modules for storing various items.

BACKGROUND OF THE INVENTION

Standard smoke detectors can be found in every home and building. The present invention features an improved smoke detector device. The smoke detector device can be mounted on a wall or ceiling including but not limited to an existing electrical fixture/box. The smoke detector device comprises a mountable base around which a ring-like structure can be attached. The ring-like structure may comprise a plurality of interconnecting modules, each module adapted to hold an item such as a smoke detector component, a speaker, a wireless network card, a camera, and/or the like. The ring-like structure provides versatility to the smoke detector device.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY

The present invention features an improved smoke detector device. In some embodiments, the device of the present invention comprises an elongated base having a top end and a generally hollow inner cavity (and optionally a bottom end, the bottom end functioning as an electrical box for example); a top aperture disposed in the top end of the base for providing access to the inner cavity of the base via the top end; a first groove disposed in an outer surface of the base, a third groove disposed in the outer surface of the base below the top end of the base, and a second groove disposed in the outer surface of the base in between the first groove and the third groove; a first flange extending outwardly from the outer surface of the base in between the first groove and the second groove, a second flange extending outwardly from the outer surface of the base in between the second groove and the third groove, and a third flange extending outwardly from the outer surface of the base above the third groove at the top end of the base; a first ring for wrapping around the first groove, a second ring for wrapping around the second groove, and a third ring for wrapping around the third groove; a first base wire opening is disposed in the first groove, a second base wire opening is disposed in the second groove, and a third base wire opening is disposed in the third groove; and a first module wire opening disposed in the first ring, a second module wire opening disposed in the second ring, and a third module wire opening disposed in the third ring, wherein the first base wire opening can be aligned with the first module wire opening, the second base wire opening can be aligned with the second module wire opening, and the third base wire opening can be aligned with the third module wire opening so as to allow a wire from the inner cavity of the base to be directed into the respective ring.

In some embodiments, the base is divided into an outer telescopic portion comprising the first groove and the first flange, a middle telescopic portion comprising the second groove and the second flange, and an inner telescopic portion comprising the third groove and the third flange, the middle telescopic portion can slide into the outer telescopic portion until the second flange and first flange contact each other, and the inner telescopic portion can slide into the middle telescopic portion until the second flange and third flange contact each other.

In some embodiments, a middle telescopic portion lip is disposed around an outer bottom edge of the middle telescopic portion of the base and an inner telescopic portion lip is disposed around an outer bottom edge of the inner telescopic portion of the base.

In some embodiments, the first flange juts inwardly toward the inner cavity of the base creating a first flange lip and the second flange juts inwardly toward the inner cavity of the base creating a second flange lip, wherein the first flange lip helps prevent the middle telescopic portion from being detached from the outer telescopic portion by blocking upward movement of the middle telescopic portion lip past the first flange lip, and the second flange lip helps prevent the inner telescopic portion from being detached from the middle telescopic portion by blocking upward movement of the inner telescopic portion lip past the second flange lip.

In some embodiments, the device further comprises a first set screw disposed in the first groove in the outer telescopic portion of the base a first distance below the first flange, the first set screw can rotate in a first direction and a second direction respectively moving the first set screw inwardly into the inner cavity of the base and outwardly away from the inner cavity of the base, wherein when the middle telescopic portion of the base is slid upwardly out of the outer telescopic portion and the first set screw is rotated in the first direction into the inner cavity of the base, the first set screw and first flange sandwich the middle telescopic portion lip to secure the middle telescopic portion out of the outer telescopic portion and when the first set screw is rotated in the second direction away from the inner cavity of the base the middle telescopic portion lip is not sandwiched between the first flange and first set screw and the middle telescopic portion slides into the outer telescopic portion.

In some embodiments, the device further comprises a second set screw disposed in the second groove in the middle telescopic portion of the base a second distance below the second flange, the second set screw can rotate in a first direction and a second direction respectively moving the second set screw inwardly into the inner cavity of the base and outwardly away from the inner cavity of the base, wherein when the inner telescopic portion of the base is slid upwardly out of the middle telescopic portion and the second set screw is rotated in the first direction into the inner cavity of the base, the second set screw and second flange sandwich the inner telescopic portion lip to secure the inner telescopic portion out of the middle telescopic portion and when the second set screw is rotated in the second direction away from the inner cavity of the base, the inner telescopic portion lip is not sandwiched between the second flange and second set screw and the inner telescopic portion is able to slide into the middle telescopic portion.

In some embodiments, the device further comprises an inner ring groove disposed in the first ring at an intersection of a top surface of the first ring and an inner cavity of the first ring, wherein the inner ring groove wraps around the first flange, second flange, and third flange when the first ring is wrapped around the first groove when the middle telescopic portion is in the outer telescopic portion and the inner telescopic portion is in the middle telescopic portion.

In some embodiments, the base is generally cylindrical in shape. In some embodiments, the grooves are generally ring-shaped. In some embodiments, each ring can pivot between an open position and a closed position via a second hinge mechanism so as to be fitted onto its respective groove. In some embodiments, the device further comprises a locking mechanism for securing each ring in the closed position. In some embodiments, the device further comprises a release button connected to the locking mechanism for unlocking the locking mechanism.

In some embodiments, one or more rings comprises at least two modules, each module comprising an inner chamber and a door, the inner chamber of each module can hold an item, the door of each module can move between an open position and a closed position for respectively allowing and preventing access to the inner chamber of the module. In some embodiments, the modules can removably connect together via a connecting means (e.g., a hinge mechanism, a locking mechanism, an assembly clip, a clamp, a snap, an adhesive, a hook-and-loop fastener, or a combination thereof).

In some embodiments, the base further comprises a bottom end 112 (e.g., an electrical box). In some embodiments, a fixture can be mounted to the base 110 via a mounting means 130 disposed on the base 110 at the top end 111. In some embodiments, the mounting means 130 includes a mounting hole adapted to receive a screw, bolt, or nail, or an adhesive.

In some embodiments, the device of the present invention comprises a base; and a ring for removably attaching to the base, the ring comprising at least two modules that removably connect together via a connecting means to form the ring, wherein each module comprises an inner chamber and a door, the inner chamber of each module can hold an item, the door of each module can move between an open position and a closed position for respectively allowing and preventing access to the inner chamber of the module.

In some embodiments, the smoke detector device is mounted to an existing electrical fixture on the wall or ceiling. In some embodiments, the place on the ceiling or the wall is aligned with a beam or joist. In some embodiments, the base is generally cylindrical in shape. In some embodiments, a top aperture is disposed in a top end of the base for providing access to an inner cavity of the base. In some embodiments, the device further comprises a groove disposed in the base.

In some embodiments, the mounting means includes a mounting hole disposed in the base at the top end wherein the mounting hole is adapted to receive a screw, bolt, or nail, or an adhesive. In some embodiments, the mounting holes are positioned at edges of the top aperture. In some embodiments, a portion of the base at a bottom end can be temporarily removed for allowing access to the inner cavity of the base. In some embodiments, the ring can wrap around the groove of the base. In some embodiments, the device further comprises four or more modules.

In some embodiments, the connecting means includes a hinge mechanism, a locking mechanism, an assembly clip, a clamp, a snap, an adhesive, a hook-and-loop fastener, or a combination thereof. In some embodiments, the device further comprises a release button connected to the locking mechanism for unlocking the locking mechanism.

In some embodiments, the item is operatively connected to a power source, the power source including a battery or an electrical system of an existing electrical fixture. In some embodiments, a base wire opening is disposed in the groove of the base and a module wire opening is disposed in the module, the base wire opening can be aligned with the module wire opening so as to allow a wire from the inner cavity of the base to be directed into the module.

In some embodiments, the ring comprises at least two steel support rods spanning the ring from a first side to a second side, the steel support rods generally parallel to each other. In some embodiments, the steel support rods snugly fit around the base. In some embodiments, the steel support rods each have a first end and a second end, the first end having a first mounting hole and the second end having a second mounting hole.

DESCRIPTION OF PREFERRED EMBODIMENTS

Referring now to FIG. 1-12, the present invention features an improved smoke detector device 100. The smoke detector device 100 comprises a plurality of interconnecting modules (forming a ring-like structure around a central base) for storing various items, increasing the versatility of the smoke detector device 100.

Figure 3:
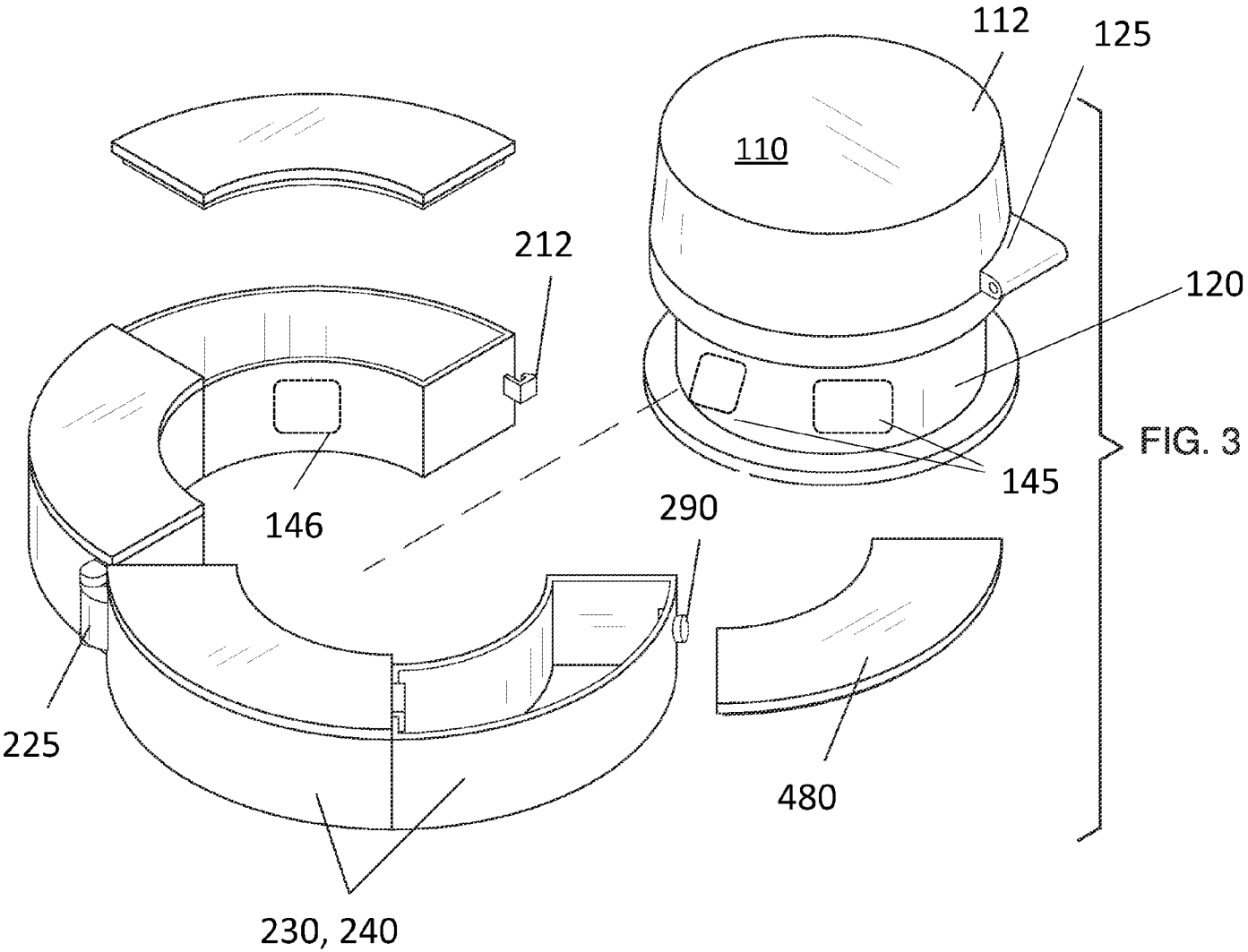
FIG. 3 is a second exploded view of the smoke alarm device of FIG. 1.
Figure 4:
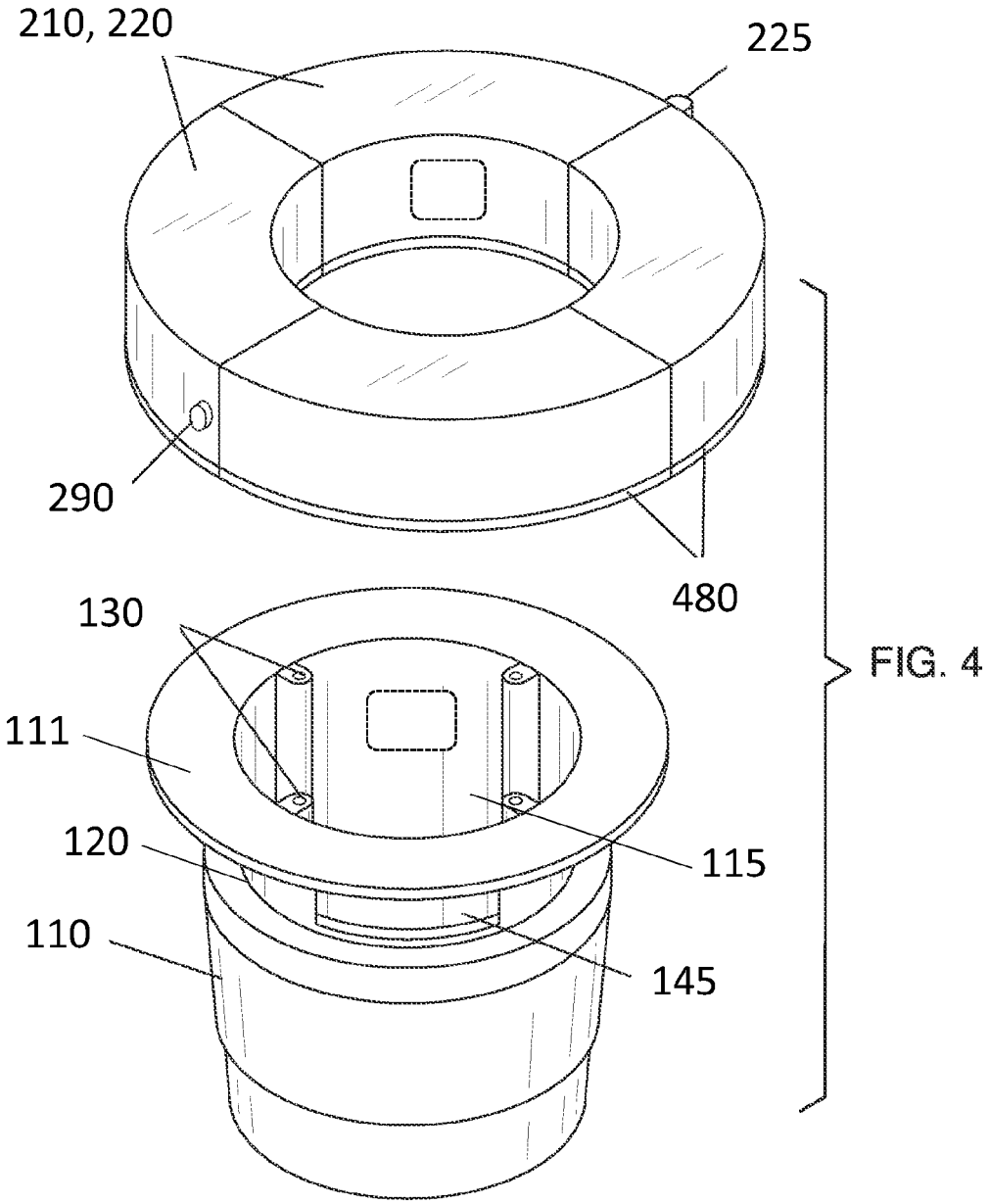
FIG. 4 is a third exploded view of the smoke alarm device of FIG. 1.

As shown in FIG. 3 and FIG. 4, the smoke detector device 100 comprises a base 110 for mounting on a wall or ceiling. The smoke detector device 100 may be mounted to a place on the wall or ceiling that is aligned with a beam or joist. In some embodiments, the smoke detector device 100 is mounted to (and in some cases connected to) an existing electrical fixture/box (e.g., a light fixture). For example, the wire components of the existing electrical fixture may be used by the smoke detector device 100 or by both the existing electrical fixture and the smoke detector device 100. In some embodiments, the smoke detector device 100 does not utilize the wire components of the existing electrical fixture/box. For example, the smoke detector device 100 is operatively connected to a battery power source, eliminating the need to be operatively connected to wire components of an existing electrical fixture.

The base 110 has an inner cavity, a top end 111, and a bottom end 112. In some embodiments, the base 110 is generally cylindrical in shape. As used herein, the term "top end" may refer to either the top or bottom of the base 110. As used herein, the term "bottom end" may refer to either the top or bottom of the base 110. For example, the top end 111 of the base 110 may be the portion that is visible if a user looks up toward the ceiling and the bottom end 112 of the base 110 may be attached to the ceiling, or vice versa. Disposed in the top end 111 of the base 110 is a top aperture 115. In some embodiments, electrical wires, for example wires from the existing electrical fixture, may be inserted into the inner cavity of the base 110 via the top aperture 115. In some embodiments, a groove 120 is disposed in the base 110, for example near the top end 111. In some embodiments, the bottom end 112 is a cap or an electrical box.

Disposed in the base 110 (e,g., in the inner cavity of the base 110) at the top end 111 of the base 110 is one or more mounting holes 130 adapted to receive screws, bolts, nails, and the like. The mounting holes 130 allow a light fixture or other fixture to be attached to the base 110. The base 110 may be attached to the wall or ceiling such that the bottom end 112 of the base is embedded in the ceiling or wall or the bottom end 112 of the base 110 is generally flush with the wall or ceiling. The screws, bolts, and/or nails can be driven through the mounting holes 130. In some embodiments, the mounting holes 130 are positioned at edges of the top aperture 115 (see FIG. 4).

Figure 8:
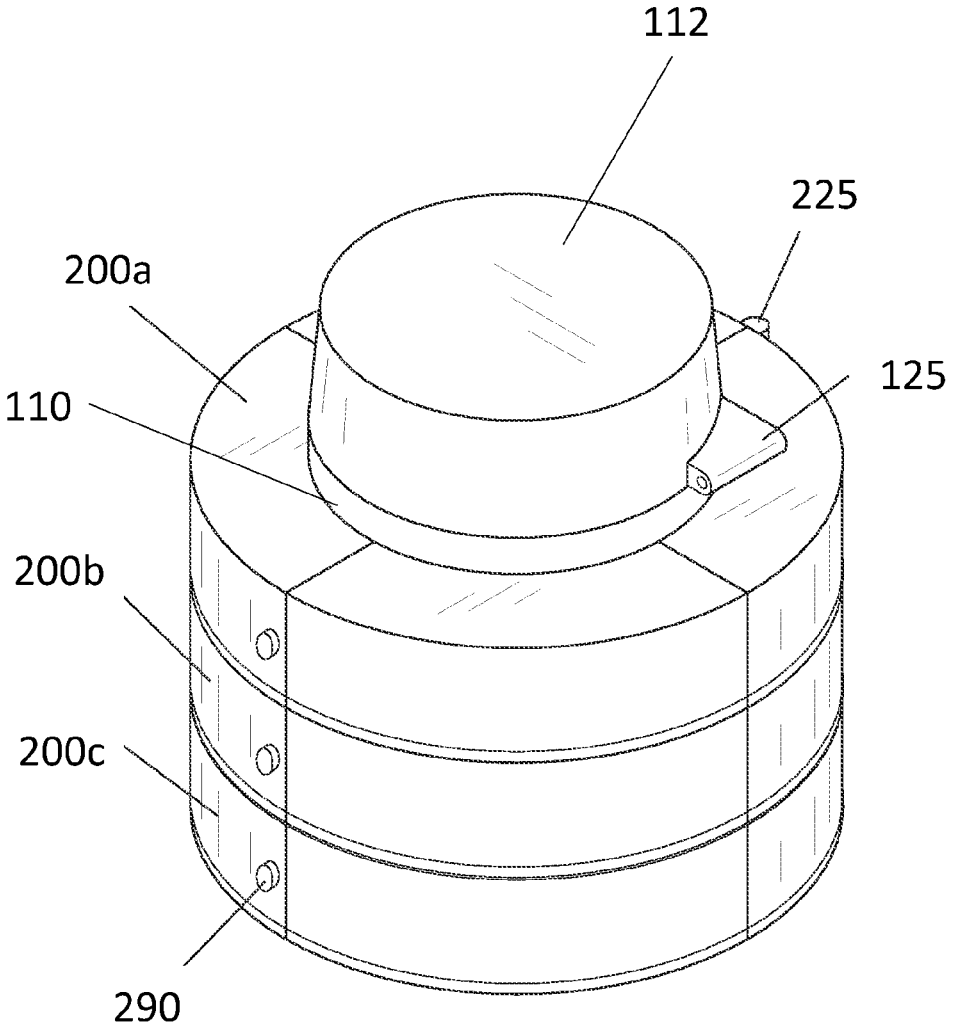
FIG. 8 is a bottom perspective view of the device of FIG. 7, wherein the rings are engaged in the respective grooves.
Figure 9:
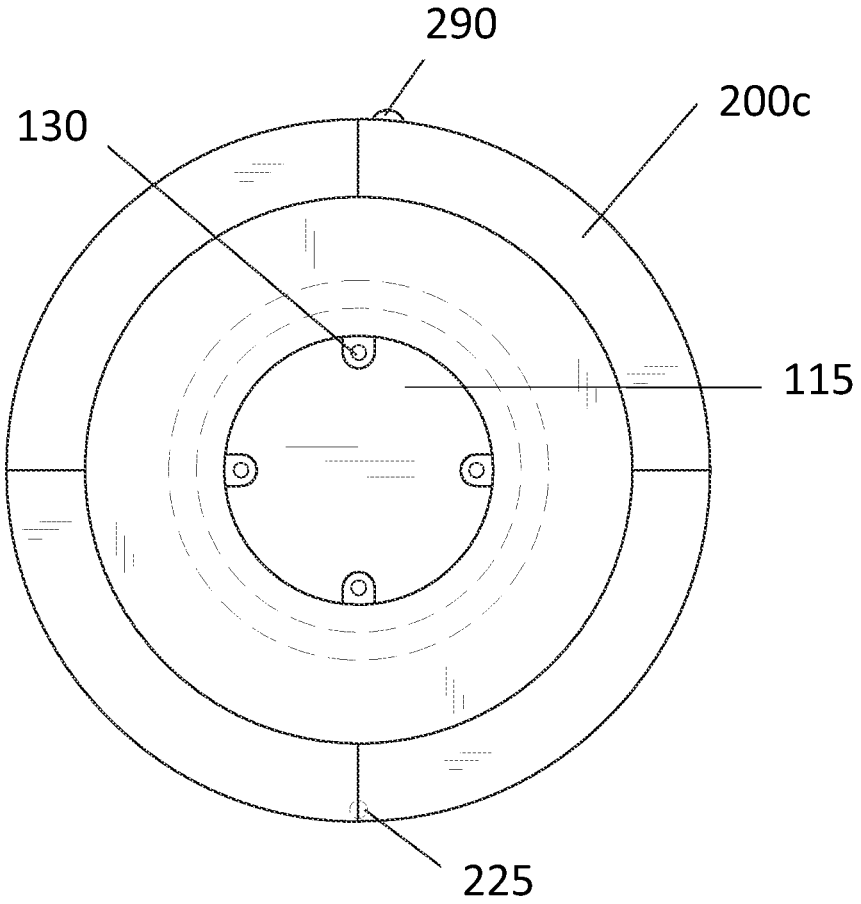
FIG. 9 is a top view of the device of FIG. 8.
Figure 10:
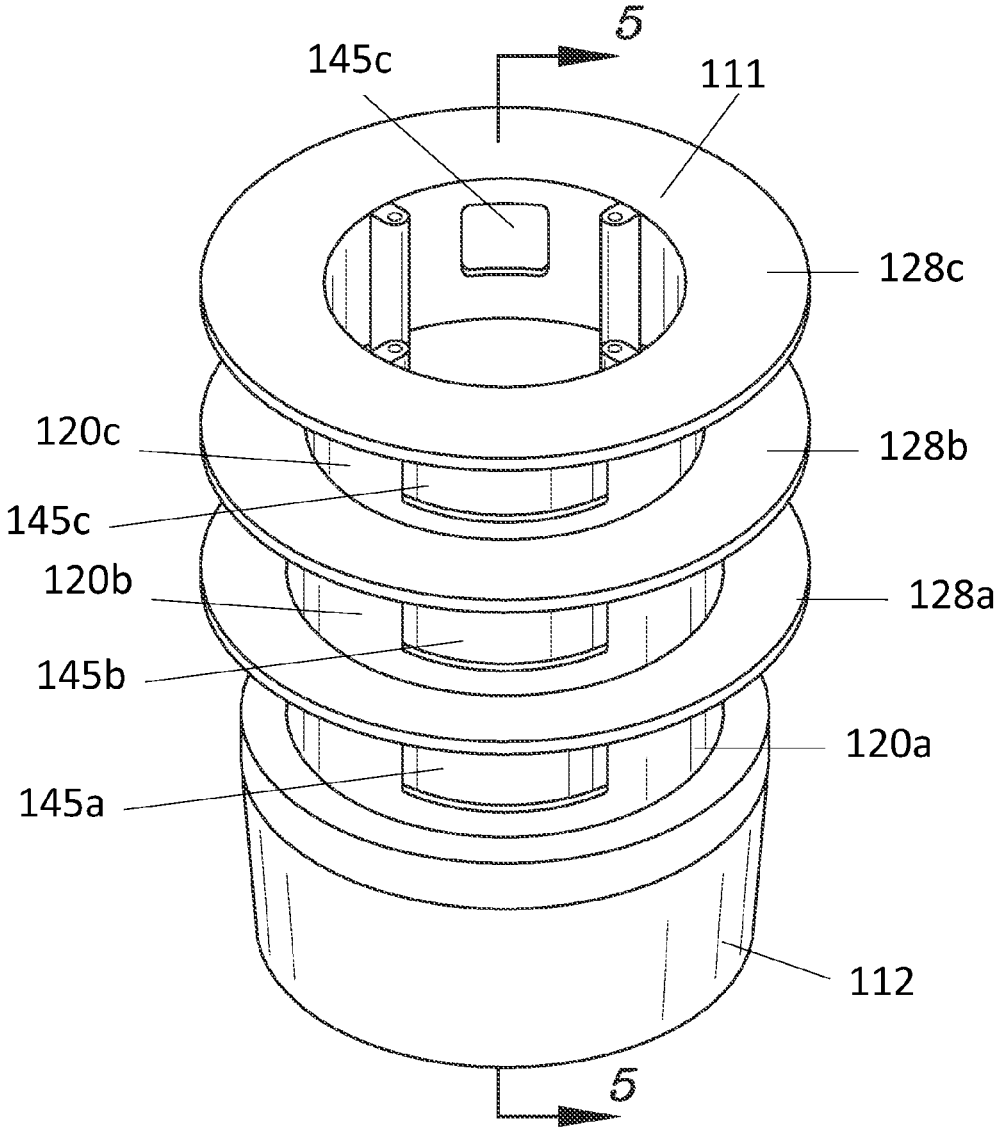
FIG. 10 is a top perspective view of the device of the present invention, wherein the device is in the expanded position. The rings are not engaged in the grooves.
Figure 11:
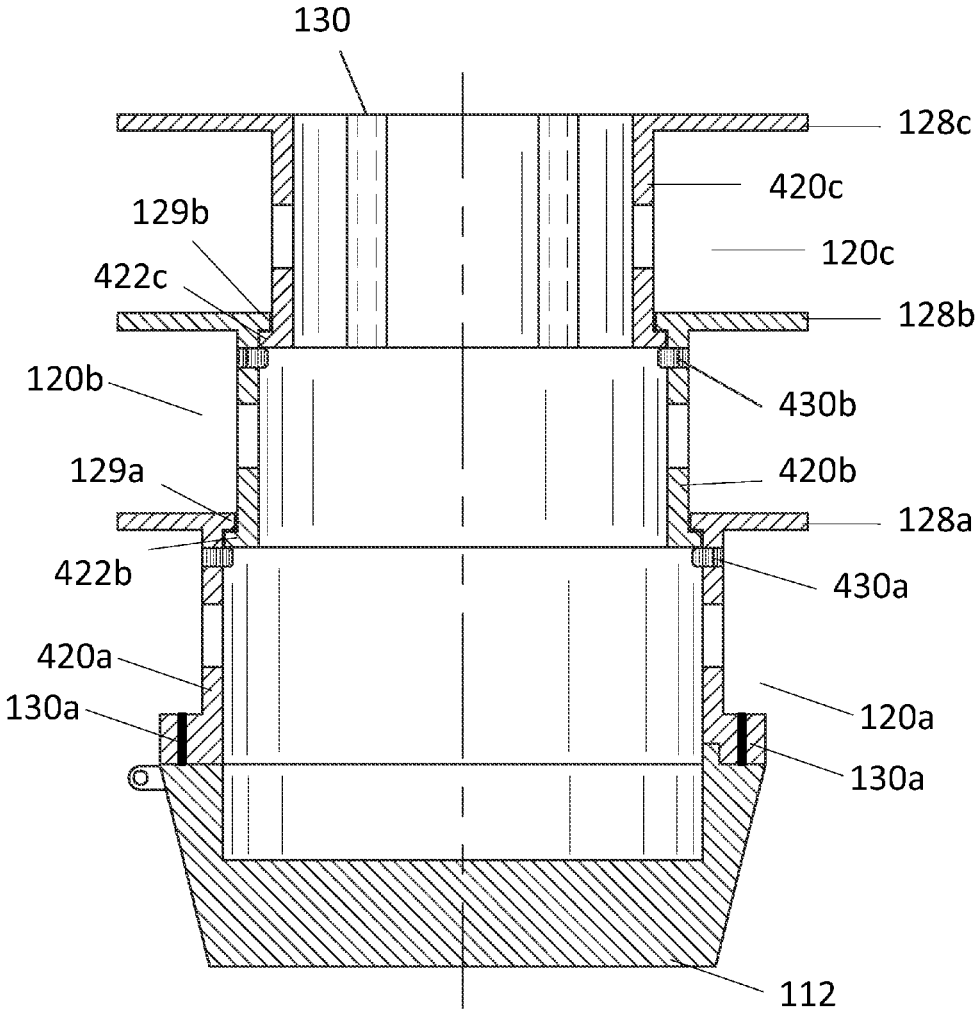
FIG. 11 is a first side cross sectional view of the device of FIG. 8, wherein the device is in the collapsed position.

In some embodiments, the bottom end 112 (e.g., cap, electrical box) or a portion of the base 110 at the bottom end 112 functions as a removable cover, for example the bottom end 112 (or a portion of the base 110 at the bottom end 112) can be removed from the base 110 for allowing access to the inner cavity of the base 110. In some embodiments, the bottom end 112 of the base 110 is removed so a user can access to the mounting holes 130 and attach the base 110 to the wall or ceiling. In some embodiments, the bottom end 112 (e.g., cap, electrical box) or a portion of the base 110 at the bottom end 112 is removably attached to the base via an attachment means. For example, as shown in FIG. 11, the attachment means may include mounting slots 130*a* disposed in the base 110 at the connection between the base 110 and the second end 112. Nails, screws, and the like can be threaded through the mounting slots 130*a* to secure the second end 112 (e.g., electrical box) to the base 110, for example. In some embodiments, a first nail slot mechanism 125*a* is disposed on the base 110 and/or on the second end 112 (e.g., electrical box), as shown in FIG. 8. In some embodiments, the first nail slot mechanism 125*a* allows a user to attach the device to a ceiling and/or joist, for example by driving a nail or screw through the first nail slot mechanism 125*a*. In some embodiments, the attachment means is a first hinge mechanism 125.

In some embodiments, the base 110 lacks the bottom end 112 (e.g., electrical box). In some embodiments, the bottom end 112 of the base 110 (or a portion of the base 110 at the bottom end 112) can be removed and an alternative item can be attached to the base 110 in its place. For example, in some embodiments, a light or a speaker is installed in place of the bottom end 112 of the base 110. In some embodiments, if the smoke detector device 100 is connected to an existing electrical fixture/box, the existing electrical fixture can still function as it did previously before the smoke detector device 100 was added. As an example, if the smoke detector device 100 is connected to an existing light fixture box, a light can be installed in lieu of the bottom end 112 of the base 110, allowing the light fixture box to still function to support the light while simultaneously supporting the smoke detector device 100.

Figure 1:
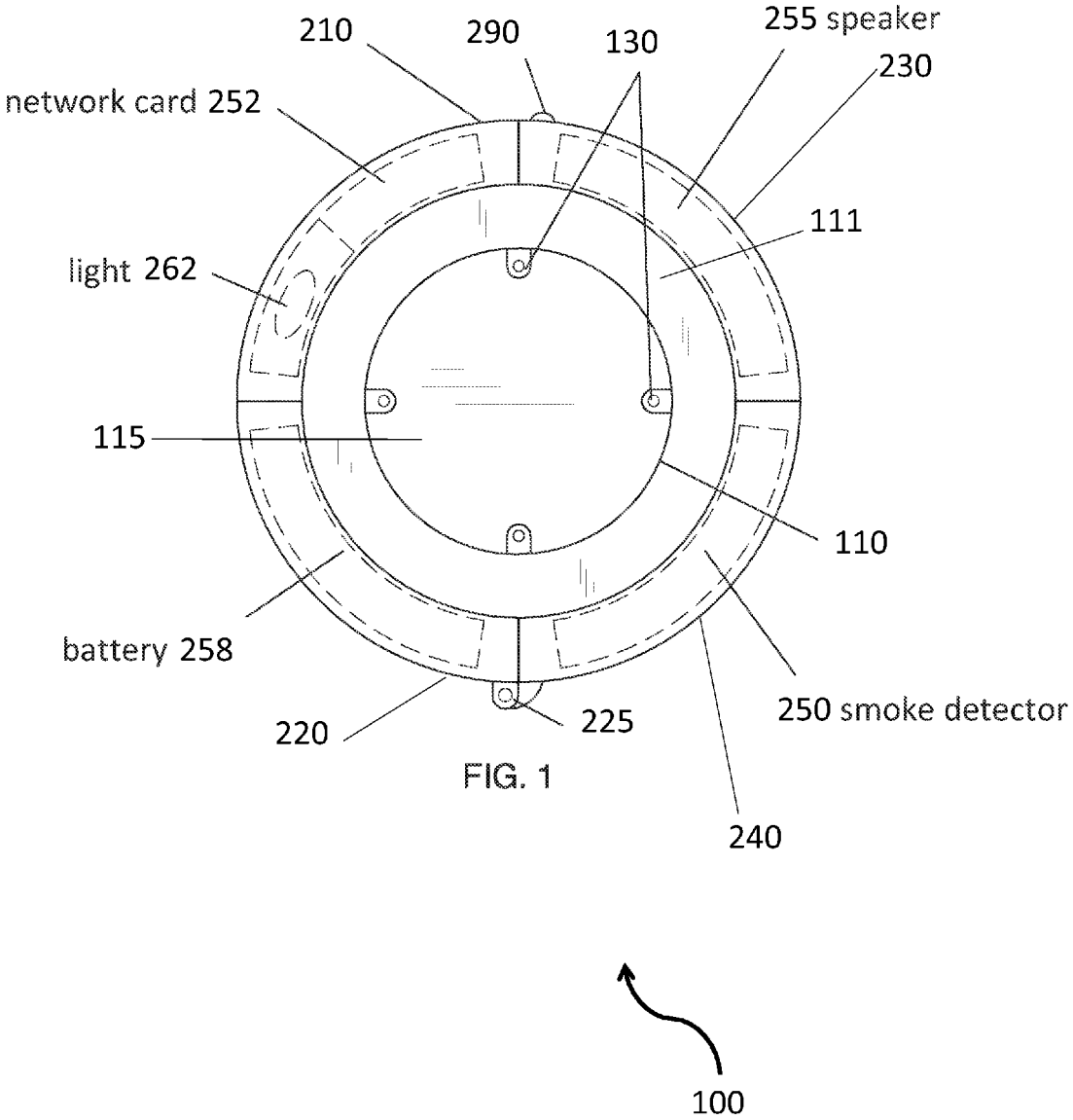
FIG. 1 is a top and internal view of a first embodiment of the smoke alarm device of the present invention.
Figure 2:
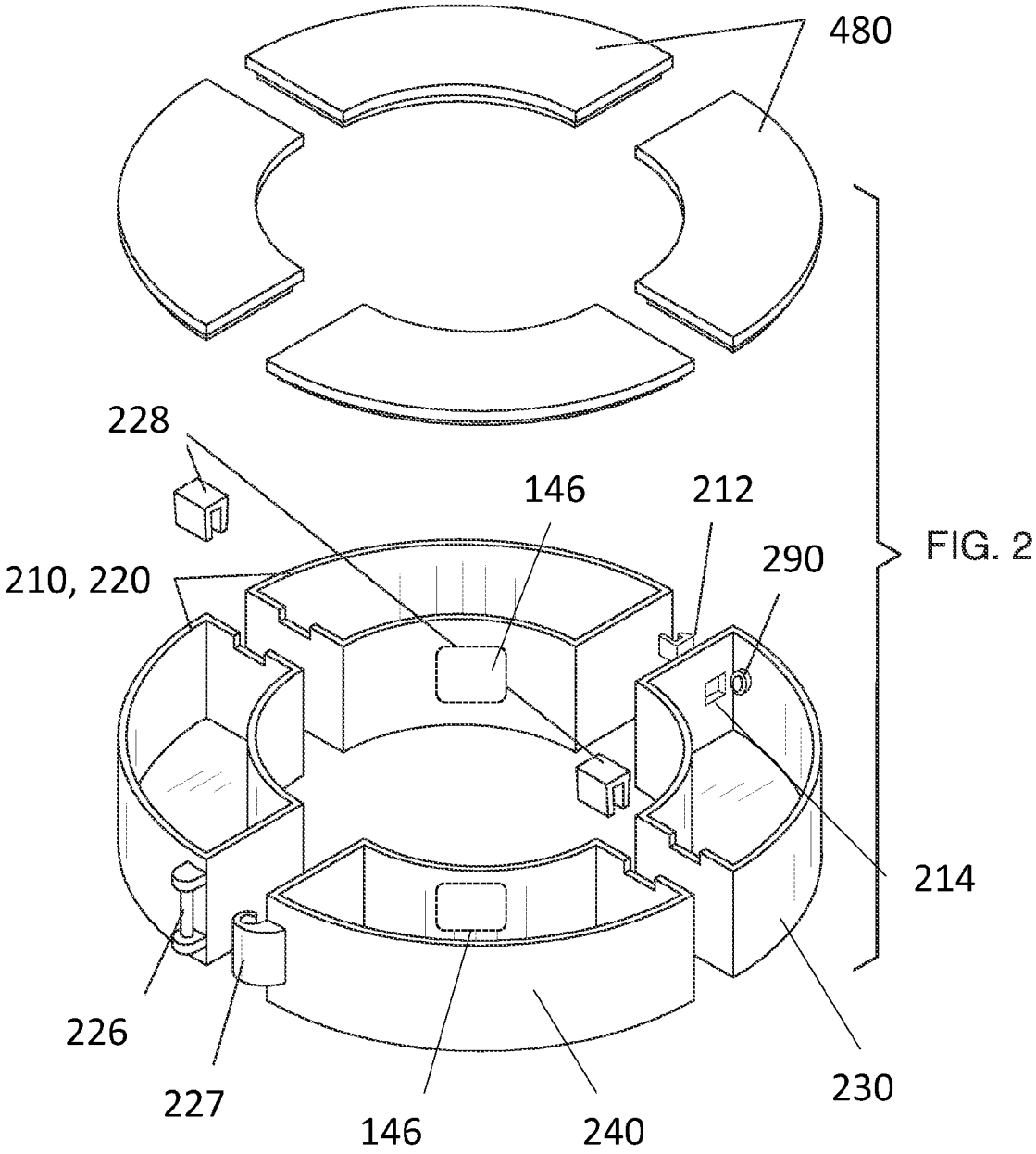
FIG. 2 is a first exploded view of the smoke alarm device of FIG. 1.

The smoke detector device 100 further comprises a ring 200 that can be removably attached to (e,g., wrapping around) the base 110. The ring 200 can move between an open and closed position so as to be fitted onto the base 110. In some embodiments, the ring 200 wraps around (e.g., snugly fits into) the groove 120 of the base 110. As shown in FIG. 1 and FIG. 2, the ring 200 may be generally circular in shape. The ring 200 is not limited to a standard circular ring shape. In some embodiments, the shape of the ring 200 is generally oval, rectangular or square, triangular, pentagonal, hexagonal, octagonal, trapezoidal, irregular, or the like. The ring 200 is not limited to the aforementioned shapes.

The ring 200 can pivot between an open position and a closed position, for example via a second hinge mechanism 225. The ring 200 may be divided into a first half ring and a second half ring, each half ring having a first end and a second end. The first end of the first half ring is pivotally attached to the first end of the second half ring, for example via the second hinge mechanism 225. The second hinge mechanism 225 may comprise hinge hook 227 disposed on the first end of the second half ring that engages (e.g., removably engages) a hinge rod 226 disposed on the first end of the first half ring. Hinge mechanisms are well known to one of ordinary skill in the art.

The second end of the first half ring may be locked to the second end of the second half ring to secure the ring 200 in the closed position. In some embodiments, a locking mechanism secures the ring 200 in the closed position. As an example, in some embodiments, a locking clip 212 is disposed on the second end of the first half ring. The locking clip 212 is for engaging a locking aperture 214 disposed in the second end of the second half ring. The locking clip 212 can snap into and out of the locking aperture 214. In some embodiments, a release button 290 is connected to the locking mechanism for unlocking the locking mechanism. For example, the release button 290 can move between a pressed position and a released position (the release button 290 may be biased in the released position, for example caused by a spring). When the release button 290 is in the pressed position, it pushes the locking clip 212 out of the locking aperture 214. Release buttons (e.g., spring-loaded buttons and the like) are well known to one of ordinary skill in the art.

The ring 200 is divided into one or more modules that connect together to form the ring via a connecting means. In some embodiments, the ring 200 is divided into two modules. In some embodiments, the ring 200 is divided into three modules. As shown in FIG. 1 and FIG. 2, in some embodiments, the ring 200 is divided into four modules, for example a first module 210, a second module 220, a third module 230, and a fourth module. The ring 200 is not limited to four modules, for example the ring 200 may comprise five, six, seven, eight, or more than eight modules. In some embodiments, the first module 210 and the second module 220 make up the first half ring. In some embodiments, the third module 230 and the fourth module 240 make up the second half ring.

As shown in FIG. 2, the modules can be separated from each other and put back together (e.g., via a connecting means) to reform the ring 200. In some embodiments, the second hinge mechanism 225 may be taken apart allowing the modules with the second hinge mechanism 225 to be separated. Separating the modules allows a user to modify the modules in the ring 200 as needed. For example, the user may have a ring 200 comprising two modules and wish to add more modules. He/she can replace one (or both) of the original modules with different modules. As an example, a single large module can be replaced with two smaller modules that combined fit where the original module was within the ring 200.

Each module has a first end and a second end. As shown in FIG. 2, the first end of the first module 210 comprises the locking clip 212 and the second end of the third module comprises the locking aperture 214 and the release button 290. The second end of the second module 220 comprises the hinge rod 226 and the first end of the fourth module 240 comprises the hinge hook 227. The locking mechanism and the second hinge mechanism 225 may be considered connecting means. The modules can be connected together via additional connecting means. In some embodiments, the modules can be connected together via assembly clips 228 that snugly snap onto ends of two modules. For example, the second end of the first module 210 can be secured to the first end of the second module via an assembly clip 228. The connecting means is not limited to assembly clips, and may include other standard connecting means such as clamps, snaps, adhesives, hook-and-loop fasteners, the like, or a combination thereof.

Each module has an inner chamber for holding items. Each module comprises a door 480 that can open and close respectively allowing and preventing access to the inner chamber of the module.

The modules of the smoke detector device 100 can accept other devices in addition to a smoke detecting component 250 including but not limited to a wireless network card 252, a speaker 255 (e.g., music speakers), a camera 272 (e.g., surveillance camera), a battery 258 (e.g., a rechargeable battery), a light 262, or a combination thereof. In some embodiments, the speakers can receive audio signals wirelessly from a music system (e.g., a stereo system, a MP3 player, etc.). In some embodiments, the music system comprises a corresponding wireless module attached to its audio output (for example, the AUX output on the back of the stereo). In some embodiments, the speaker 255 can also be programmed (e.g., via a microprocessor) to broadcast certain messages, for example a warning message in the case of a fire.

If needed, items in the modules can be operatively connected to a power source. In some embodiments, the power source is a battery (e.g., rechargeable battery). In some embodiments, the power source is the electrical system of the existing electrical fixture. Wires can be directed from the wall or ceiling into the inner cavity of the base 110 (via the top aperture). In some embodiments, a base wire opening 145 is disposed in the base 110 (e.g., in the groove 120 of the base 110). Wires can be directed out of the inner cavity of the base 110 and into a module (e.g., via a module wire opening 146 in the module). The base wire opening 145 in the base 110 may be aligned with the module wire opening 146 of the module.

Figure 5:
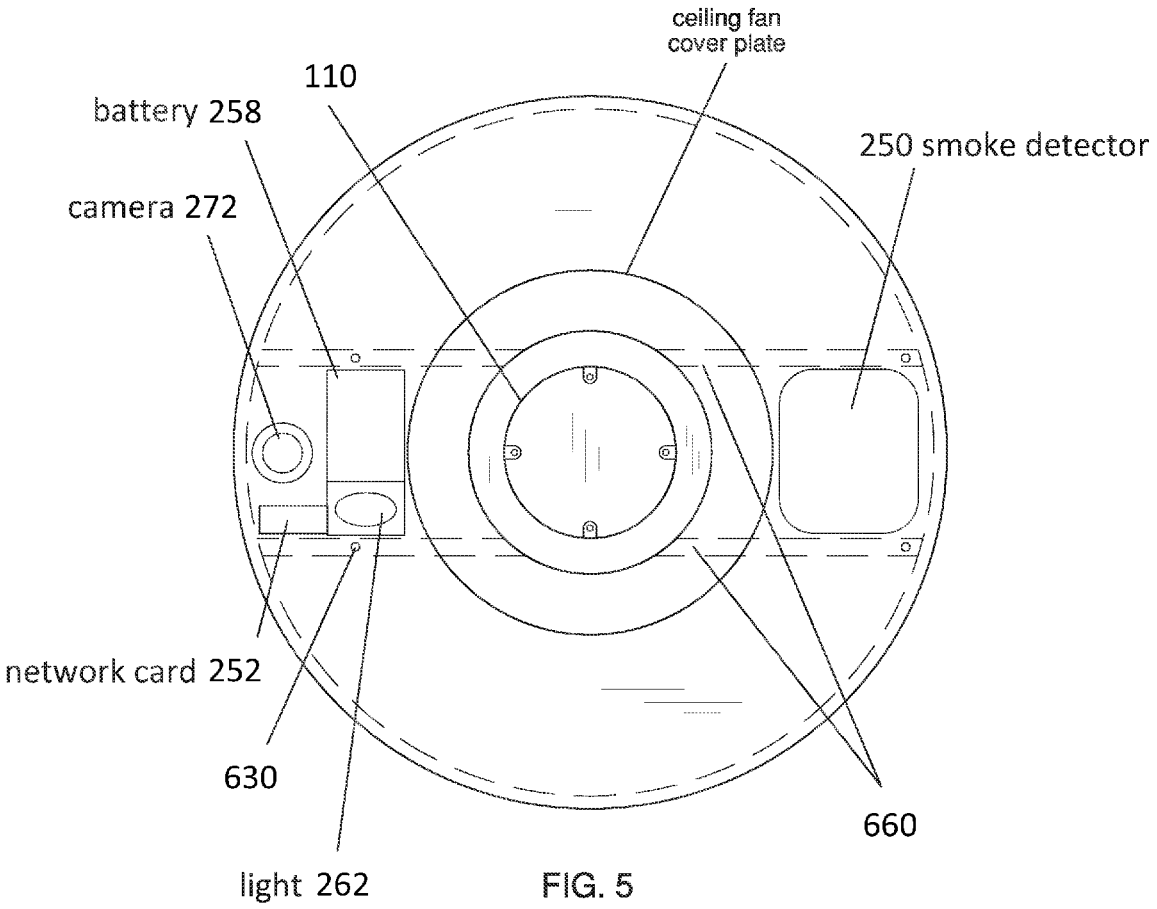
FIG. 5 is a top and internal view of a second embodiment of the smoke alarm device of the present invention.
Figure 6:
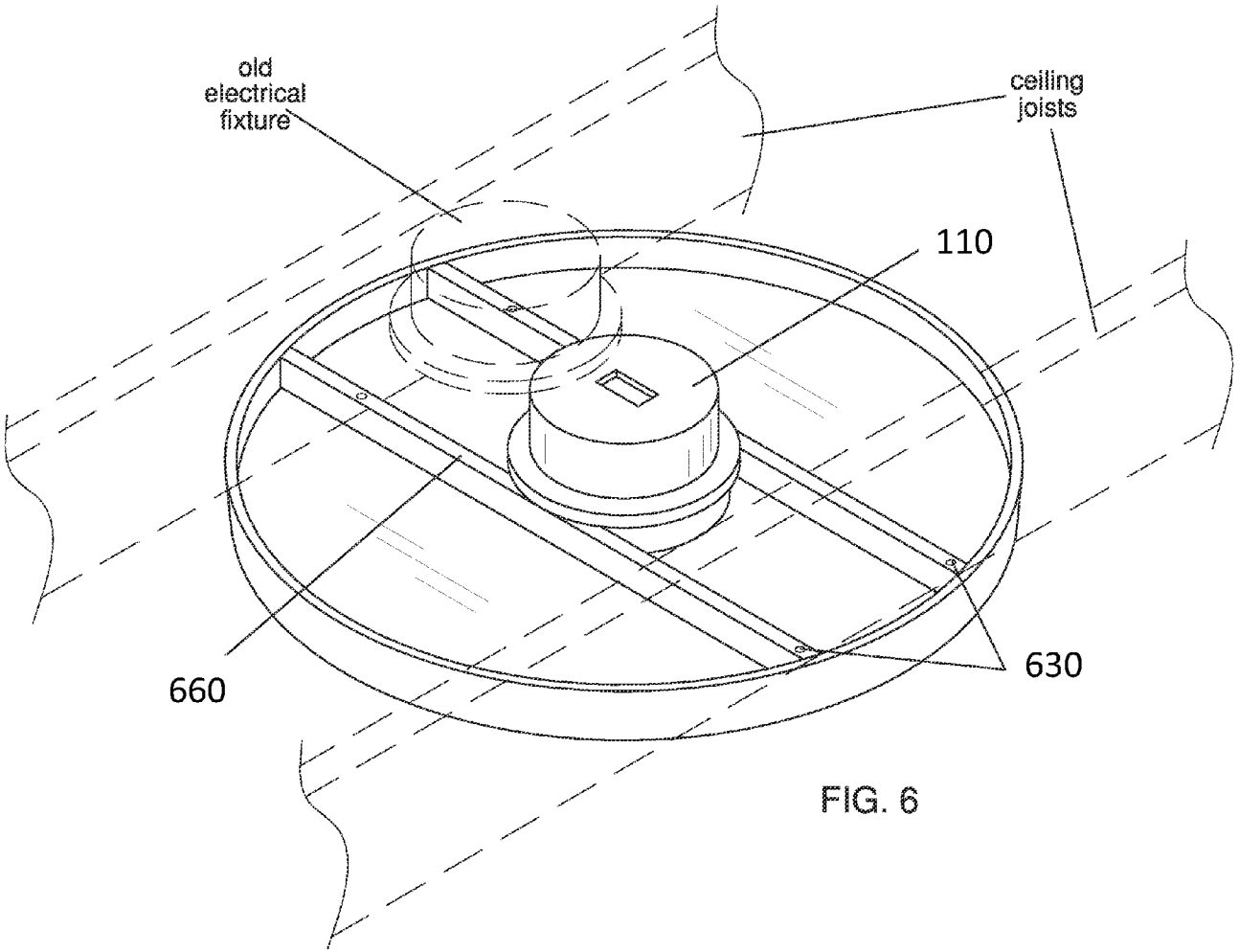
FIG. 6 is a perspective view of the smoke alarm device of FIG. 5.

As shown in FIG. 5 and FIG. 6, the ring 200 may comprise one or more (e.g., two) steel support rods for providing additional support when mounting the smoke detector device 100 to the wall or ceiling. The steel support rods 660 may run parallel to each other, spanning the ring from a first side to a second side. The steel support rods 660 may be positioned a certain distance apart so that the steel support rods 660 snugly fit around the base 110 (e.g., the groove 120 of the base 110). The steel support rods 660 have a first end and a second end, the first end having a first mounting hole 630 and the second end having a second mounting hole 630. The steel support rods are long enough to be attached to two beams or joists, for example the first end is aligned (e.g., perpendicularly aligned) with a first joist and the second end is aligned (e.g., perpendicularly aligned) with a second joist.

As shown in FIG. 5, in some embodiments, the steel support rods 660 and the base 110 combined form inner chambers that can hold various items including but not limited to a camera 272, a wireless network card 252, a light 262, a battery 258, and the smoke detector component 250.

In some embodiments, the smoke alarm component comprises a rechargeable battery than can be charged whenever the electrical fixture (e.g., light switch) is turned on. (The rechargeable battery may be operatively connected to the electrical fixture/wiring). This may eliminate the need for the user to replace the battery (which may require a possibly dangerous ascent up a ladder), as in current household smoke alarm designs. In some embodiments, the smoke detector component can alert the user when the battery needs charging via an alarm (beeping) or even a user-programmed voice message.

Figure 7:
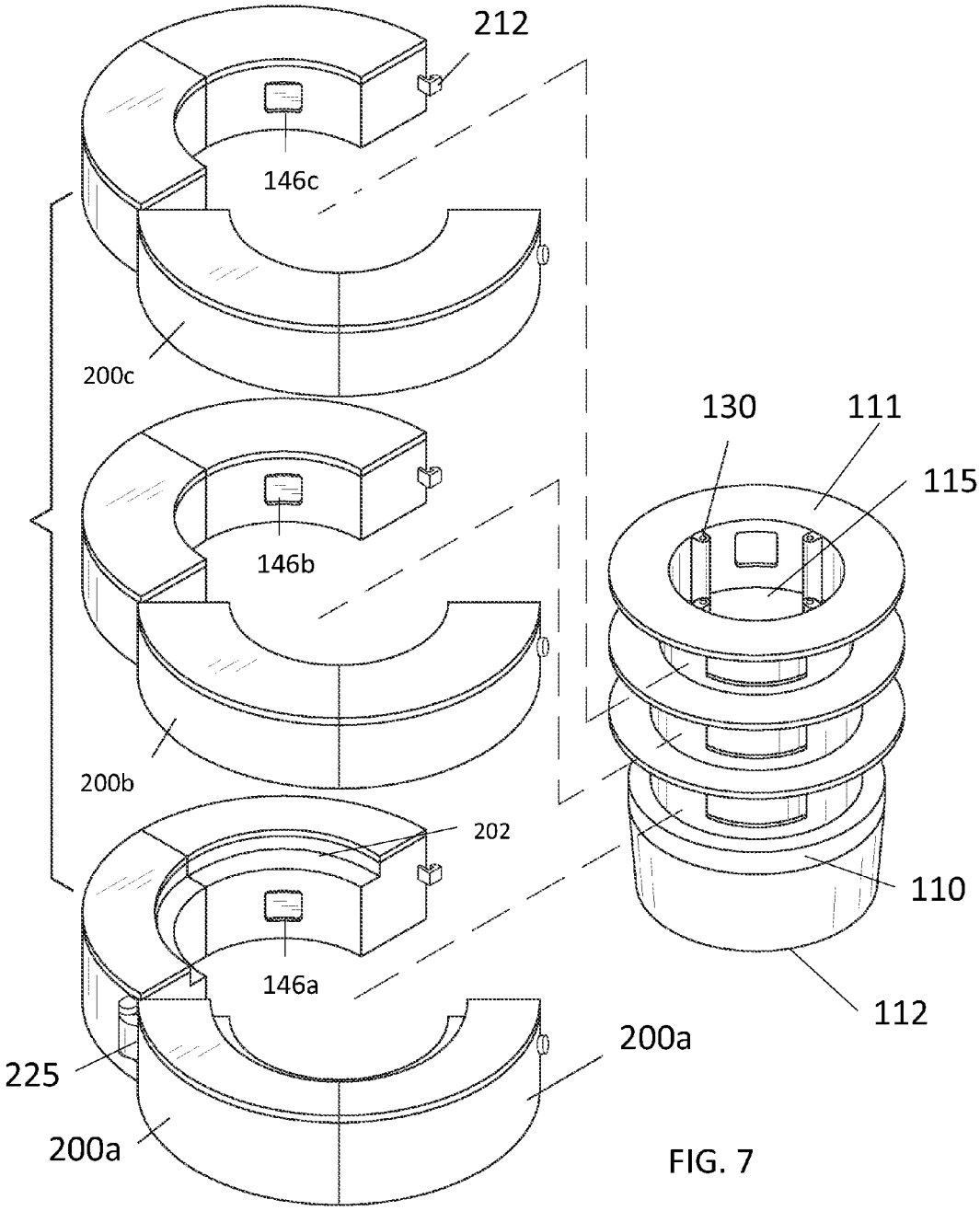
FIG. 7 is an exploded view of an alternative embodiment of the device of the present invention.

Referring now to FIG. 7-12, the smoke detector device 100 comprises a base 110 (e.g., a generally cylindrical base) having a top end 111 and a generally hollow inner cavity. In some embodiments, the base 110 comprises a bottom end 112 (e.g., electrical box, for example). As used herein, the term "top end" may refer to either the top or bottom of the base 110. As used herein, the term "bottom end" may refer to either the top or bottom of the base 110. For example, the top end 111 of the base 110 may be the portion that is visible if a user looks up toward the ceiling and the bottom end 112 of the base 110 may be attached to the ceiling, or vice versa. As shown in FIGS. 7 and 8, the base 110 may be generally elongated. Disposed in the top end 111 of the base 110 is a top aperture 115 providing access to the inner cavity of the base 110. In some embodiments, electrical wires, for example wires from the existing electrical fixture, may be inserted into the inner cavity of the base 110 via the top aperture 115.

Disposed along the base 110 (along the outer surface of the base 110) in between the top end 111 and the optional bottom end 112 (e.g., electrical box) is a first groove 120*a*, a second groove 120*b*, and a third groove 120*c*. The grooves 120 are indentations in the outer surface of the base 110. The grooves 120 are generally ring-shaped. The first groove 120*a* is positioned above the optional bottom end 112 (e.g., electrical box) of the base 110, the third groove 120*c* is positioned below the top end 111 of the base 110, and the second groove 120*a* is positioned in between the first groove 120*a* and the third groove 120*c*.

In some embodiments, a first flange 128*a* extends outwardly from the outer surface of the base 110 in between the first groove 120*a* and the second groove 120*b*. In some embodiments, a second flange 128*b* extends outwardly from the outer surface of the base 110 in between the second groove 120*b* and the third groove 120*c*. In some embodiments, a third flange 128*c* is disposed at the top end 111 of the base 1110 above the third groove 120*c* (e.g., the top end 111 of the base forms the first flange 128*c*).

Figure 12:
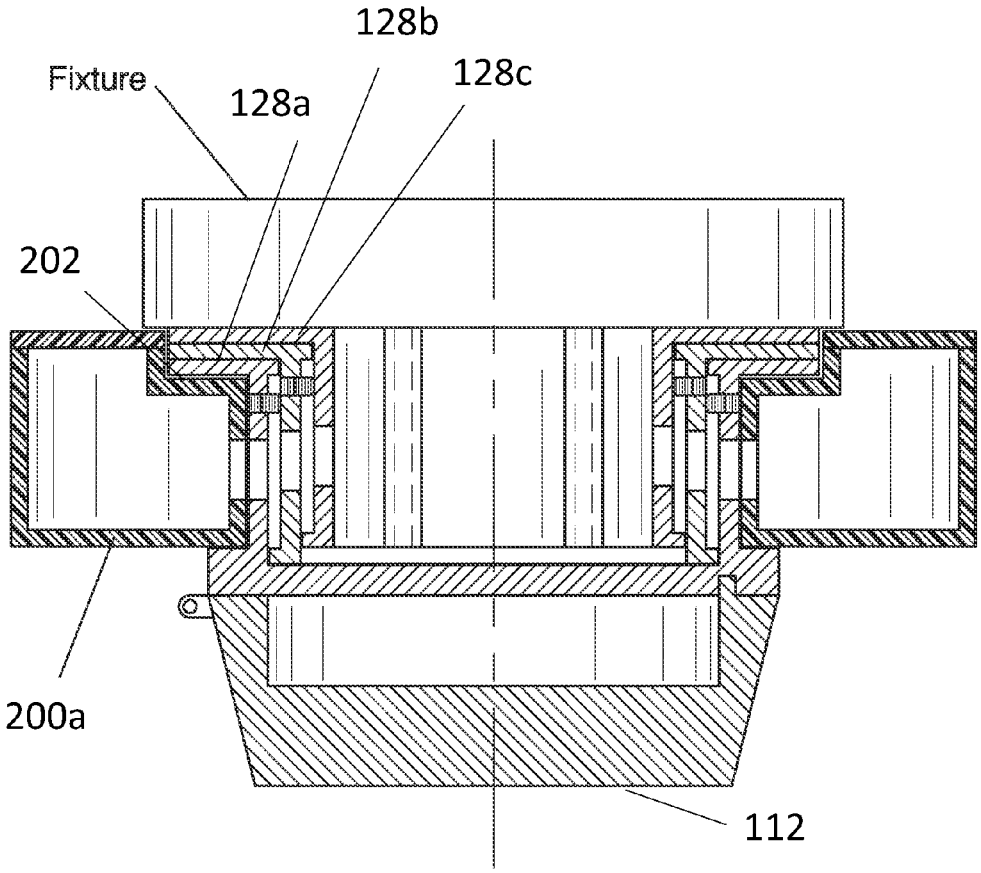
FIG. 12 is a second side cross sectional view of the device of FIG. 8, wherein the device is in the expanded position.

Disposed on the base 110 at the top end 111 of the base 110 is one or more mounting holes 130 adapted to receive screws, bolts, nails, and the like. The mounting holes 130 may be, for example, disposed at the intersection of the top end 111 of the base 110 and the aperture 115 in the top end 111 of the base 110. The mounting holes 130 allow a light fixture or other fixture to be attached to the base 110 (e.g., see FIG. 12 showing a fixture attached to the top end of the base 110). The base 110 may be attached to the wall or ceiling such that the optional bottom end 112 (e.g., electrical box) of the base is embedded in the ceiling or wall or the optional bottom end 112 (e.g., electrical box) of the base 110 is generally flush with the wall or ceiling. The screws, bolts, and/or nails can be driven through the mounting holes 130. Screws, bolts, and/or nails can be driven through the mounting holes 130.

In some embodiments, the optional bottom end 112 (e,g., electrical box) is removablee. In some embodiments, the bottom end 112 or a portion of the base 110 at the bottom end 112 is removably attached to the base 110 via an attachment means. For example, as shown in FIG. 11, the attachment means may include mounting slots 130*a* disposed in the base 110 at the connection between the base 110 and the second end 112. Nails, screws, and the like can be threaded through the mounting slots 130*a* to secure the second end 112 (e.g., electrical box) to the base 110, for example. In some embodiments, a first nail slot mechanism 125*a* is disposed on the base 110 and/or on the second end 112 (e.g., electrical box), as shown in FIG. 8. In some embodiments, the first nail slot mechanism 125*a* allows a user to attach the device to a ceiling and/or joist, for example by driving a nail or screw through the first nail slot mechanism 125*a*.

In some embodiments, the optional bottom end 112 (e.g., electrical box) of the base 110 can be removed and an alternative item can be attached to the base 110 in its place. For example, in some embodiments, a light or a speaker is installed in place of the bottom end 112 of the base 110. In some embodiments, if the smoke detector device 100 is connected to an existing electrical fixture/box, the existing electrical fixture can still function as it did previously before the smoke detector device 100 was added. As an example, if the smoke detector device 100 is connected to an existing light fixture box, a light can be installed in lieu of the bottom end 112 of the base 110, allowing the light fixture box to still function to support the light while simultaneously supporting the smoke detector device 100.

In some embodiments, the smoke detector device 100 further comprises a plurality (e.g., two, three, etc.) of rings 200 that can be removably attached to (e.g., wrapping around) the base 110. The rings 200 can each move between an open and closed position so as to be fitted onto the base 110. In some embodiments, the smoke detector device 100 comprises a first ring 200*a* (e.g., for a smoke alarm), a second ring 200*b*, and a third ring 200*c*. The first ring 200*a* wraps around the first groove 120*a*, the second ring 200*b* wraps around the second groove 120*b*, and the third ring 200*c* wraps around the third groove 120*c*.

Each ring 200 can pivot between an open position and a closed position, for example via a second hinge mechanism 225. Each ring 200 may be divided into a first half ring and a second half ring, each half ring having a first end and a second end. The first end of the first half ring is pivotally attached to the first end of the second half ring, for example via the second hinge mechanism 225. Hinge mechanisms are well known to one of ordinary skill in the art.

In some embodiments, an inner ring groove 202 is disposed in the first ring 200*a*, for example in the inner cavity of the first ring 200*a* (e.g., at the intersection of the top surface of the first ring 200*a* and the inner cavity of the first ring 200*a*, as shown in FIG. 7), The second end of each first half ring may be lockable to the second end of the respective second half ring to secure the ring 200 in the closed position. In some embodiments, a locking mechanism secures the ring 200 in the closed position. As an example, in some embodiments, a locking clip 212 is disposed on the second end of each first half ring. The locking clip 212 is for engaging a locking aperture 214 disposed in the second end of the respective second half ring. The locking clip 212 can snap into and out of the locking aperture 214. In some embodiments, a release button 290 is connected to each locking mechanism for unlocking the locking mechanism. For example, the release button 290 can move between a pressed position and a released position (the release button 290 may be biased in the released position, for example caused by a spring). When the release button 290 is in the pressed position, it pushes the respective locking clip 212 out of the locking aperture 214. Release buttons (e.g., spring-loaded buttons and the like) are well known to one of ordinary skill in the art.

In some embodiments, the rings 200 are divided into one or more modules that connect together to form the ring via a connecting means (e.g., see FIG. 2). Each module has an inner chamber for holding items. Each module comprises a door 480 (see FIG. 2) that can open and close respectively allowing and preventing access to the inner chamber of the module.

The modules of the smoke detector device 100 can accept other devices in addition to a smoke detecting component 250 including but not limited to a wireless network card 252, a speaker 255 (e.g., music speakers), a camera 272 (e.g., surveillance camera), a battery 258 (e.g., a rechargeable battery), a light 262, or a combination thereof (see FIG. 5). In some embodiments, the speakers can receive audio signals wirelessly from a music system (e.g., a stereo system, a MP3 player, etc.). In some embodiments, the music system comprises a corresponding wireless module attached to its audio output (for example, the AUX output on the back of the stereo). In some embodiments, the speaker 255 can also be programmed (e.g., via a microprocessor) to broadcast certain messages, for example a warning message in the case of a fire.

If needed, items in the rings 200 (modules) can be operatively connected to a power source. In some embodiments, the power source is a battery (e.g., rechargeable battery). In some embodiments, the power source is the electrical system of the existing electrical fixture. Wires can be directed from the wall or ceiling into the inner cavity of the base 110 (via the top aperture). In some embodiments, one or more base wire openings 145 are disposed in the base 110 (e.g., in the grooves 120 of the base 110), for example in the first groove 120*a*, second groove 120*b*, and third groove 120*c* (see FIG. 10). Wires can be directed out of the electrical box (e.g., bottom end 112 of the base 110) or inner cavity of the base 110 and into a ring 200 (e.g., a module) via module wire openings 146 in the ring/module. Base wire openings 145 in the base 110 may be aligned with module wire openings 146 of the rings 200 (modules). For example, a first base wire opening 145*a* is disposed in the first groove 120*a*, which can be aligned with a first module wire opening 146*a* disposed in the first ring 200*a*. A second base wire opening 145*b* is disposed in the second groove 120*b*, which can be aligned with a second module wire opening 146*b* disposed in the second ring 200*b*. A third base wire opening 145*c* is disposed in the third groove 120*c*, which can be aligned with a third module wire opening 146*d* disposed in the third ring 200*c*. Each ring 200 may have more than one module wire opening 146, and each groove 120 may have more than one base wire opening 145.

As shown in FIG. 11 and FIG. 12, the device 100 of the present invention can move between multiple positions including but not limited to an expanded position wherein the grooves 120 are each exposed (see FIG. 11) and a collapsed position wherein only the first groove 120*a* is exposed (see FIG. 12). In the expanded position, rings 200 can be wrapped around each exposed groove 120. In the collapsed position, only the first ring 200*a* can be wrapped around the first groove 120*a*, since only the first groove 120*a* is exposed. As shown in FIG. 11, the base 110 is divided into telescopic portions, wherein the third groove 120*c* is in the inner telescopic portion 420*c*, the second groove 120*b* is in the middle telescopic portion 420*b*, and the third groove 120*c* is in the outer telescopic portion 420*a*. In some embodiments, the outer telescopic portion 420*a* has a diameter larger than that of the middle telescopic portion 420*b*, which has a diameter larger than that of the inner telescopic portion 420*c* (see FIG. 11). The middle telescopic portion 420*b* slides into the outer telescopic portion 420*a*, and the inner telescopic portion 420*c* slides into the middle telescopic portion 420*b*. The first flange 128*a* is part of the outer telescopic portion 420*a* (at the top edge), the second flange 128*b* is part of the middle telescopic portion 420*b* (at the top edge), and the third flange 128*c* is part of the inner telescopic portion 420*c*.

The first flange 128*a* and the second flange 128*b* contact each other when the middle telescopic portion 420*b* slides into the outer telescopic portion 420*a*. The third flange 128*c* and the second flange 128*b* contact each other when the inner telescopic portion 420*c* slides into the middle telescopic portion 420*b*. The inner ring groove 202 of the first ring 200*a* accommodates the first flange 128*a*, second flange 128*b*, and third flange 128*c* when the device 100 is in the collapsed position, for example the inner ring groove 202 of the first ring 200*a* wraps around the flanges 128 allowing the first ring 200*a* to be wrapped around the first groove 120*a* despite the presence of the flanges 128.

Disposed around the outer bottom edge of the middle telescopic portion 420*b* of the base 110 is a middle telescopic portion lip 422*b*. The first flange 128*a* juts inwardly slightly (inwardly toward the inner cavity of the base 110) creating a first flange lip 129*a*. In the expanded position, the middle telescopic portion lip 422*b* and the first flange lip 129*a* of the first flange 128 contact each other. The middle telescopic portion lip 422*b* and the first flange lip 129*a* help prevent the middle telescopic portion 420*b* from being detached from the outer telescopic portion 420*a*. For example, the first flange lip 129*a* blocks further upward movement of the middle telescopic portion lip 422*c* if the middle telescopic portion 420*b* is pulled too far away from the outer telescopic portion 420*a*.

Disposed around the outer bottom edge of the inner telescopic portion 420*c* of the base 110 is an inner telescopic portion lip 422*c*. The second flange 128*b* juts inwardly slightly (inwardly toward the inner cavity of the base 110) creating a second flange lip 129*b*. In the expanded position, the inner telescopic portion lip 422*c* and the second flange lip 129*b* of the second flange 128*b* contact each other. The inner telescopic portion lip 422*c* and the second flange lip 129*b* help prevent the inner telescopic portion 420*c* from being detached from the middle telescopic portion 420*b*. For example, the second flange lip 129*b* blocks further upward movement of the inner telescopic portion lip 422*c* if the inner telescopic portion 420*c* is pulled too far away from the middle telescopic portion 420*b*.

A first set screw 430*a* (or more than one first set screws 430*a*) is disposed in the first groove 120*a* (in the outer telescopic portion 420*a* of the base 110) near (and under) the first flange 128*a*. The first set screw 430*a* can be rotated in a first direction and a second direction respectively moving the first set screw 430*a* inwardly towards (and into) the inner cavity of the base 110 and outwardly away from the base 110. The first flange 128*a* and the first set screw 430*a* are spaced apart a first distance. The first distance accommodates the middle telescopic portion lip 422*b*. When the middle telescopic portion 420*b* of the base is slid (upwardly) out of the outer telescopic portion 420*a* and the first set screw 430*a* is rotated in the first direction into the inner cavity of the base 110, the first set screw 430*a* and first flange 128 sandwich the middle telescopic portion lip 422*b*. This secures the middle telescopic portion 420*b* in the expanded position (out of the outer telescopic portion 420*a*) as shown in FIG. 11. If the first set screw 430*a* is rotated in the second direction away from the inner cavity of the base 110, the middle telescopic portion lip 422*b* is not sandwiched between the first flange 128*a* and first set screw 430*a* and the middle telescopic portion 420*b* is able to slide into the outer telescopic portion 420*a* (to the collapsed position, see FIG. 12).

A second set screw 430*b* (or more than one second set screws 430*b*) is disposed in the second groove 120*b* (in the middle telescopic portion 420*b* of the base 110) near (and under) the second flange 128*b*. The second set screw 430*b* can be rotated in a first direction and a second direction respectively moving the second set screw 430*b* inwardly towards (and into) the inner cavity of the base 110 and outwardly away from the base 110. The second flange 128*b* and the second set screw 430*b* is spaced apart a second distance. The second distance accommodates the inner telescopic portion lip 422*c*. When the inner telescopic portion 420*c* of the base is slid (upwardly) out of the middle telescopic portion 420*b* and the second set screw 430*b* is rotated in the first direction into the inner cavity of the base 110, the second set screw 430*b* and second flange 128*b* sandwich the inner telescopic portion lip 422*c*. This secures the inner telescopic portion 420*c* in the expanded position (out of the middle telescopic portion 420*b*) as shown in FIG. 11. If the second set screw 430*b* is rotated in the second direction away from the inner cavity of the base 110, the inner telescopic portion lip 422*c* is not sandwiched between the second flange 128*b* and second set screw 430*b* and the inner telescopic portion 420*c* is able to slide into the middle telescopic portion 420*b* (to the collapsed position, see FIG. 12).

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A smoke detector device comprising:

(a) an elongated base 110 having a top end 111 and a generally hollow inner cavity;

(b) a top aperture 115 disposed in the top end 111 of the base 110 for providing access to the inner cavity of the base 110 via the top end 111;

(c) a first groove 120*a* disposed in an outer surface of the base 110, a third groove 120*c* disposed in the outer surface of the base 110 below the top end 111 of the base 110, and a second groove 120*a* disposed in the outer surface of the base 110 in between the first groove 120*a* and the third groove 120*c;*

(d) a first flange 128*a* extending outwardly from the outer surface of the base 110 in between the first groove 120*a* and the second groove 120*b*, a second flange 128*b* extending outwardly from the outer surface of the base 110 in between the second groove 120*b* and the third groove 120*c*, and a third flange 128*c* extending outwardly from the outer surface of the base 110 above the third groove 120*c* at the top end 111 of the base 110;

(e) a first ring 200*a* for wrapping around the first groove 120*a*, a second ring 200*b* for wrapping around the second groove 120*b*, and a third ring 200*c* for wrapping around the third groove 120*c;*

(f) a first base wire opening 145*a* is disposed in the first groove 120*a*, a second base wire opening 145*b* is disposed in the second groove 120*b*, and a third base wire opening 145*c* is disposed in the third groove 120*c*; and (g) a first module wire opening 146*a* disposed in the first ring 200*a*, a second module wire opening 146*b* disposed in the second ring 200*b*, and a third module wire opening 146*c* disposed in the third ring 200*c*, wherein the first base wire opening 145*a* can be aligned with the first module wire opening 146*a*, the second base wire opening 145*b* can be aligned with the second module wire opening 146*b*, and the third base wire opening 145*c* can be aligned with the third module wire opening 146*c* so as to allow a wire from the inner cavity of the base to be directed into the respective ring 200.

2. The smoke detector device of claim 1, wherein the base 110 is divided into an outer telescopic portion 420*a* comprising the first groove 120*a* and the first flange 128*a*, a middle telescopic portion 420*b* comprising the second groove 120*b* and the second flange 128*b*, and an inner telescopic portion 420*c* comprising the third groove 120*c* and the third flange 128*c*, the middle telescopic portion 420*b* can slide into the outer telescopic portion 420*a* until the second flange 128*b* and first flange 128*a* contact each other, and the inner telescopic portion 420*c* can slide into the middle telescopic portion 420*b* until the second flange 128*b* and third flange 128*c* contact each other.

3. The smoke detector device of claim 2, wherein a middle telescopic portion lip 422*b* is disposed around an outer bottom edge of the middle telescopic portion 420*b* of the base 110 and an inner telescopic portion lip 422*c* is disposed around an outer bottom edge of the inner telescopic portion 420*c* of the base 110.

4. The smoke detector device of claim 3, wherein the first flange 128*a* juts inwardly toward the inner cavity of the base 110 creating a first flange lip 129*a* and the second flange 128*b* juts inwardly toward the inner cavity of the base 110 creating a second flange lip 129*b*, wherein the first flange lip 129*a* helps prevent the middle telescopic portion 420*b* from being detached from the outer telescopic portion 420*a* by blocking upward movement of the middle telescopic portion lip 422*b* past the first flange lip 129*a*, and the second flange lip 129*b* helps prevent the inner telescopic portion 420*c* from being detached from the middle telescopic portion 420*b* by blocking upward movement of the inner telescopic portion lip 422*c* past the second flange lip 129*b*.

5. The smoke detector device of claim 4 further comprising a first set screw 430*a* disposed in the first groove 120*a* in the outer telescopic portion 420*a* of the base 110 a first distance below the first flange 128*a*, the first set screw 430*a* can rotate in a first direction and a second direction respectively moving the first set screw 430*a* inwardly into the inner cavity of the base 110 and outwardly away from the inner cavity of the base 110, wherein when the middle telescopic portion 420*b* of the base is slid upwardly out of the outer telescopic portion 420*a* and the first set screw 430*a* is rotated in the first direction into the inner cavity of the base 110, the first set screw 430*a* and first flange 128 sandwich the middle telescopic portion lip 422*b* to secure the middle telescopic portion 420*b* out of the outer telescopic portion 420*a* and when the first set screw 430*a* is rotated in the second direction away from the inner cavity of the base 110 the middle telescopic portion lip 422*b* is not sandwiched between the first flange 128*a* and first set screw 430*a* and the middle telescopic portion 420*b* slides into the outer telescopic portion 420*a*.

6. The smoke detector device of claim 5 further comprising a second set screw 430*b* disposed in the second groove 120*b* in the middle telescopic portion 420*b* of the base 110 a second distance below the second flange 128*b*, the second set screw 430*b* can rotate in a first direction and a second direction respectively moving the second set screw 430*b* inwardly into the inner cavity of the base 110 and outwardly away from the inner cavity of the base 110, wherein when the inner telescopic portion 420*c* of the base is slid upwardly out of the middle telescopic portion 420*b* and the second set screw 430*b* is rotated in the first direction into the inner cavity of the base 110, the second set screw 430*b* and second flange 128*b* sandwich the inner telescopic portion lip 422*c* to secure the inner telescopic portion 420*c* out of the middle telescopic portion 420*b* and when the second set screw 430*b* is rotated in the second direction away from the inner cavity of the base 110, the inner telescopic portion lip 422*c* is not sandwiched between the second flange 128*b* and second set screw 430*b* and the inner telescopic portion 420*c* is able to slide into the middle telescopic portion 420*b*.

7. The smoke detector device of claim 6 further comprising an inner ring groove 202 disposed in the first ring 200*a* at an intersection of a top surface of the first ring 200*a* and an inner cavity of the first ring 200*a*, wherein the inner ring groove 202 wraps around the first flange 128*a*, second flange 128*b* and third flange 128*c* when the first ring 200*a* is wrapped around the first groove 120*a* when the middle telescopic portion 420*b* is in the outer telescopic portion 420*a* and the inner telescopic portion 420*c* is in the middle telescopic portion 420*b*.

8. The smoke detector device of claim 1, wherein the base 110 is generally cylindrical in shape.

9. The smoke detector device of claim 1, wherein the grooves 120 are generally ring-shaped.

10. The smoke detector device of claim 1, wherein the base further comprises a bottom end 112.

11. The smoke detector device of claim 10, wherein the bottom end 112 is an electrical box.

12. The smoke detector device of claim 1, wherein each ring 200 can pivot between an open position and a closed position via a second hinge mechanism 225 so as to be fitted onto its respective groove 120.

13. The smoke detector device of claim 12 further comprising a locking mechanism 212, 214 for securing each ring 200 in the closed position.

14. The smoke detector device of claim 13 further comprising a release button 290 connected to the locking mechanism 212, 214 for unlocking the locking mechanism 212, 214.

15. The smoke detector device of claim 1, wherein at least one ring 200 comprises at least two modules 210, 220, 230, 240, each module 210, 220, 230, 240 comprising an inner chamber and a door 480, the inner chamber of each module 210, 220, 230, 240 can hold an item, the door 480 of each module 210, 220, 230, 240 can move between an open position and a closed position for respectively allowing and preventing access to the inner chamber of the module 210, 220, 230, 240.

16. The smoke detector device of claim 15, wherein the modules 210, 220, 230, 240 can removably connect together via a connecting means 228.

17. The smoke detector device of claim 16, wherein the connecting means 228 includes a hinge mechanism, a locking mechanism, an assembly clip, a clamp, a snap, an adhesive, a hook-and-loop fastener, or a combination thereof.

18. The smoke detector device of claim 1, wherein a fixture can be mounted to the base 110 via a mounting means 130 disposed on the base 110 at the top end 111.

19. The smoke detector device of claim 18, wherein the mounting means 130 includes a mounting hole adapted to receive a screw, bolt, or nail, or an adhesive.

* * * * *